US006783421B1

(12) United States Patent
Lopez

(10) Patent No.: US 6,783,421 B1
(45) Date of Patent: Aug. 31, 2004

(54) WATERPROOF ILLUMINATED DISC FLYER

(76) Inventor: Frank Lopez, 1532 W. Huisache Ave., #2, San Antonio, TX (US) 78201

( * ) Notice: Subject to any disclaimer, the term of this patent is extended or adjusted under 35 U.S.C. 154(b) by 0 days.

(21) Appl. No.: 10/614,284

(22) Filed: Jul. 8, 2003

(51) Int. Cl.[7] ..... A63H 23/00
(52) U.S. Cl. ..... 446/153; 446/47; 446/485
(58) Field of Search ..... 446/46–48, 153, 446/242, 255, 256, 485; 473/588–589, 570

(56) References Cited

U.S. PATENT DOCUMENTS

| | | | | |
|---|---|---|---|---|
| 3,720,018 A | | 3/1973 | Peterson et al. | |
| 3,786,246 A | | 1/1974 | Johnson et al. | |
| 3,798,834 A | | 3/1974 | Samuel | |
| 4,086,723 A | | 5/1978 | Strawick | |
| 4,207,702 A | | 6/1980 | Boatman et al. | |
| 4,254,575 A | | 3/1981 | Gould | |
| D260,786 S | | 9/1981 | Chaklos | |
| 4,307,538 A | * | 12/1981 | Moffitt | 446/47 |
| 4,778,428 A | * | 10/1988 | Wield | 446/47 |
| 5,083,799 A | | 1/1992 | Thill | |
| 5,290,184 A | * | 3/1994 | Balogh et al. | 446/47 |
| D386,221 S | | 11/1997 | Ybanez | |
| 5,882,239 A | | 3/1999 | Trichak | |
| 6,547,623 B1 | * | 4/2003 | Collado | 446/47 |

* cited by examiner

*Primary Examiner*—Jack K. Ackun
*Assistant Examiner*—Jamila O. Williams
(74) *Attorney, Agent, or Firm*—Richard C. Litman

(57) ABSTRACT

The waterproof illuminated disc flyer is an illuminated and waterproof flying plastic disc. The disc has upper and lower disc members sealed together at the outer perimeter of the discs, and is illuminated by light-emitting diodes (LEDs). A pushbutton switch and a battery compartment are enclosed within a waterproof enclosure formed between the upper and lower discs. A battery cover having a thin depressible plastic membrane enables a user to toggle the switch from outside the waterproof interior. The upper surface of the flying disc has a centered dome having six spokes, each spoke having a LED extending from alternating opposite ends.

13 Claims, 10 Drawing Sheets

WATERPROOF ILLUMINATED DISC FLYER

BACKGROUND OF THE INVENTION

1. Field of the Invention

The present invention relates generally to aerial toys. More specifically, the invention is directed towards an illuminated and waterproof flying plastic disc.

2. Description of the Related Art

Flying discs have been available on the market for a number of years. Aerodynamically designed, these discs when hurled properly can soar for extended distances. Requiring minimal physical exertion, these toys can be played with for hours on end, well into the evening hours. With ordinary flying discs, however, nighttime presents a challenge, not only in retrieving a misdirected toss, but also exposing the user to the risk of personal injury by being hit by a errant disc or by miscalculation when catching a firmly thrown disc. In response to the challenges of nighttime use and in the desire to provide a visually pleasing toy, lighted flying discs have been introduced to the marketplace.

U.S. Des. Pat. No. 260,786, issued to Chaklos in 1981, discloses the ornamental design for an illumination device for attaching to a toy flying saucer. Similarly, U.S. Des. Pat. No. 386,221, issued to Ybanez in 1997, discloses an ornamental design for an illuminated disc flyer showing a battery, battery holder, and electrical connections.

U.S. Pat. No. 3,720,018, issued to Peterson et al. in 1973, discloses a flying disc, which is illuminated for night flying. The '018 patent includes a dome, within which a battery, switch and a single lamp is mounted.

U.S. Pat. No. 3,786,246, issued to Johnson et al. in 1974, discloses a "Frisbee®" type flying saucer having a plurality of regularly spaced lamps disposed proximate to the outer rim of the flying disc. The battery holder, lights, and electrical wiring is all embodied in a unitary structure having a central hub in which the battery holder is located, with a plurality of regularly spaced arms extending radially outward from the hub, the lights being located at the ends of the arms, and the electrical conductor extending along the arms.

U.S. Pat. No. 3,798,384, issued to Samuel in 1974, discloses a generally saucer-shaped body and at least one battery-powered audio or visual signaling device with a centrifugally actuated switch oriented to close and to energize the device when the device is rotating.

Although electrical means may provide the most variety in stimulating special effects for flying discs, there are alternative methods used to provide illumination in flying discs for nighttime use that do not require a waterproof enclosure for electronic circuitry. U.S. Pat. Nos. 4,086,723, 4,207,702, 4,254,575, 5,083,799 and 5,882,239 all disclose chemiluminescent light sources for illuminating the toy without generating heat and without electronic components.

Although satisfying the functional requirement of remaining visible in the dark, these chemiluminescent flying discs do not offer the same visually stimulating lighting effects, such as flashing lights, either in a synchronized or random pattern.

None of the above inventions and patents, taken either singly or in combination, is seen to describe the instant invention as claimed. Thus a waterproof illuminated disc flyer solving the aforementioned problems is desired.

SUMMARY OF THE INVENTION

The waterproof illuminated disc flyer is an illuminated and waterproof flying plastic disc. The disc includes a switch for turning on a plurality of light-emitting diodes (LEDs) powered by a battery held in place by a clip. In addition to providing enhanced appeal, the lights enable playing with the toy in the absence of light. Structurally, the upper outer surface of the disc has a centered dome with six internal spokes having LEDs at alternating opposite ends. The bottom surface is concave with a stepped configuration, sloping from the center to the outer edges with the outer edge projecting slightly outward to protect the lights. Because the disc is waterproof and floats, the toy may be used in or around bodies of water.

Accordingly, it is a principal object of the invention to provide a flying disc which is illuminated so that the disc can be played with at night.

It is another object of the invention to provide a waterproof illuminated flying disc that can float and be played with in or near the water without risk of loss or damage.

It is a further object of the invention to provide an illuminated flying disc in which all electronic components are sealed within the device.

Still another object of the invention is to provide an illuminated flying disc in which the lights are protected from damage.

It is still another object of the invention to provide an illuminated flying disc whose aerodynamic characteristics are not degraded by the electronics within.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
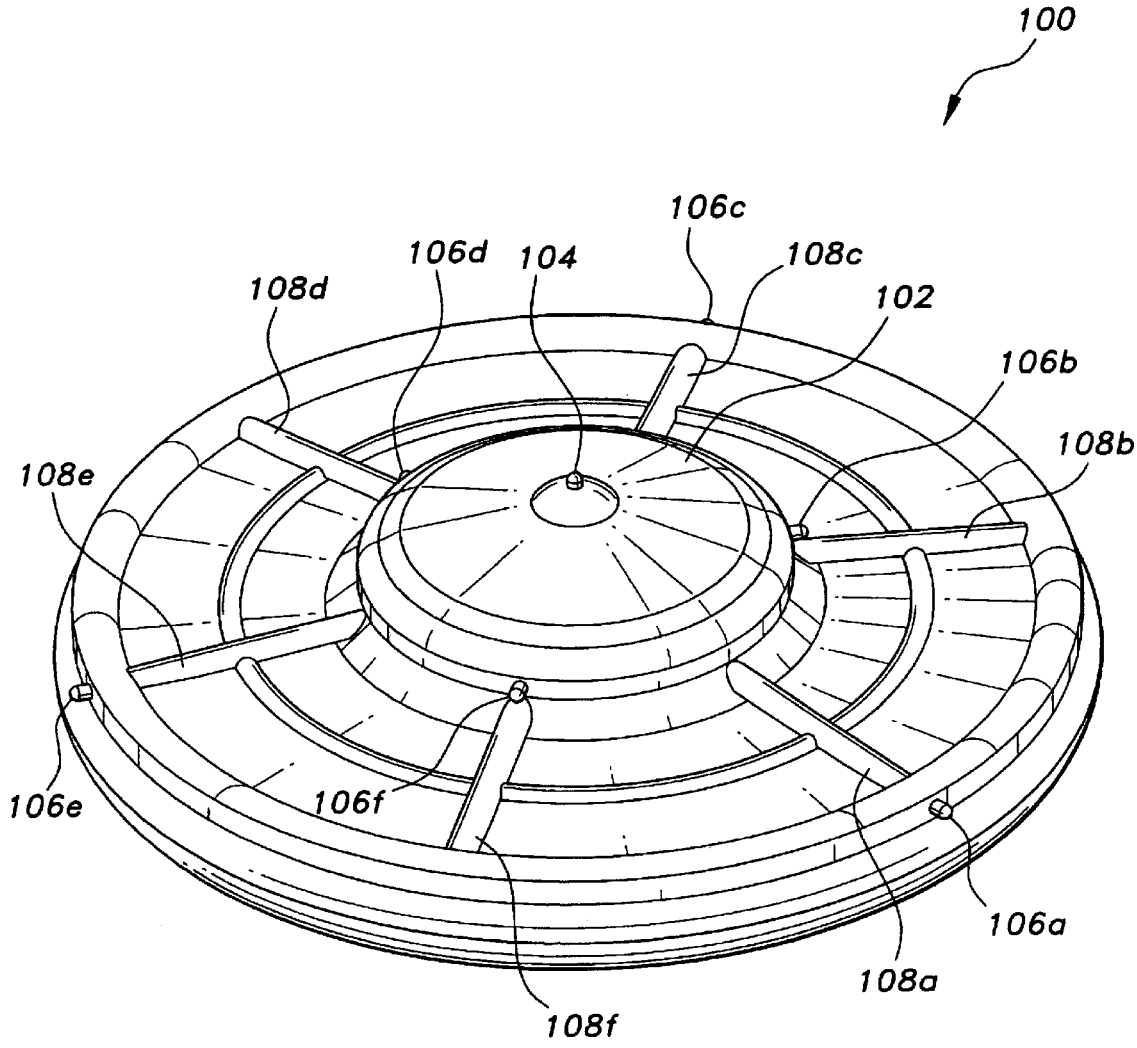
FIG. 1 is a perspective view of a waterproof illuminated disc flyer according to the present invention.

The present invention is a waterproof, illuminated flying disc designated generally as 100 in the drawings. As shown in FIG. 1, the flying disc 100 has LEDs 106*a–f* to facilitate nighttime use. The waterproof design enables the flying disc 100 to be used in or near the water without risk of damaging the electronic components sealed within.

Figure 2:
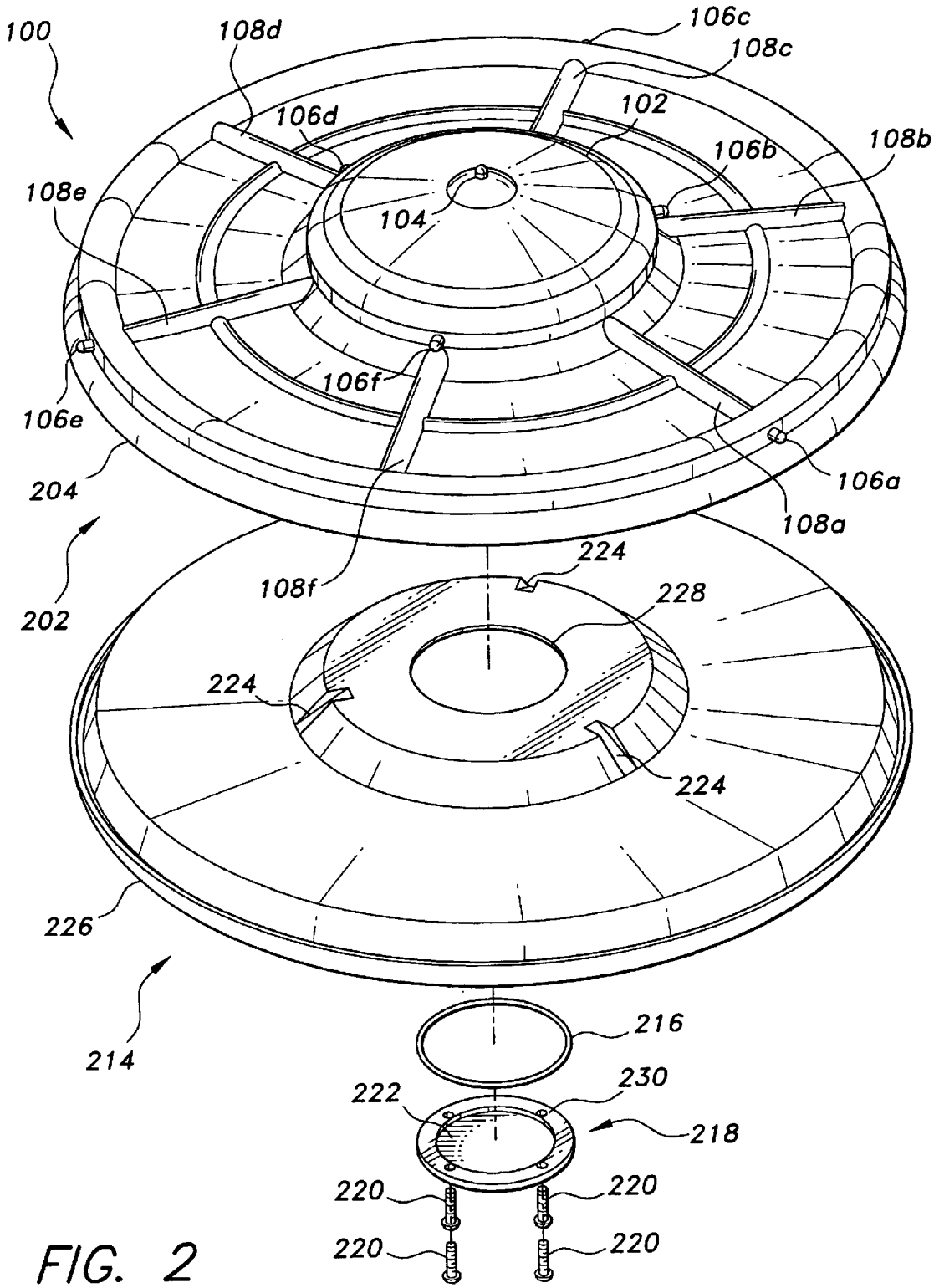
FIG. 2 is an exploded view of the waterproof illuminated disc flyer of FIG. 1.

As further shown in FIGS. 1 and 2, a generally disc-shaped upper disc member 202 cooperatively engages and is sonic welded to a generally disc-shaped and concave lower disc member 214 at their respective peripheries 204 and 226, forming a downwardly pointing rim. The upper disc member 202 has an upper surface, a lower surface, a centrally disposed dome 102 and six molded spokes 108*a–f* uniformly spaced extending radially outward from the dome 102 to the periphery 204. The structural components of the flying disc 100 are constructed of molded plastic which are welded together to form a waterproof interior compartment and to provide positive buoyancy.

The lens of LED 104 extends upward through an aperture cut in the center of the dome 102 and additional LEDs 106*a–f* protrude outwards from the upper disc member 202 at alternating opposite ends of the molded spokes 108*a–f*. The LED may be further sealed in place with a waterproof adhesive to prevent moisture from entering the flying disc 100. Wire access passages 224 molded into the lower disc member 214 provide access to LEDs 106*a*, 106*c*, and 106*e* on the periphery 204 of the flying disc 100.

The lower disc member 214 has an inner periphery 228 surrounding an opening, which exposes a battery and switch compartment within the underside of dome 102. The inner periphery 228 is sonic welded to the upper disc member 102 to guarantee a waterproof seal between the upper and lower disc members.

Figure 4:
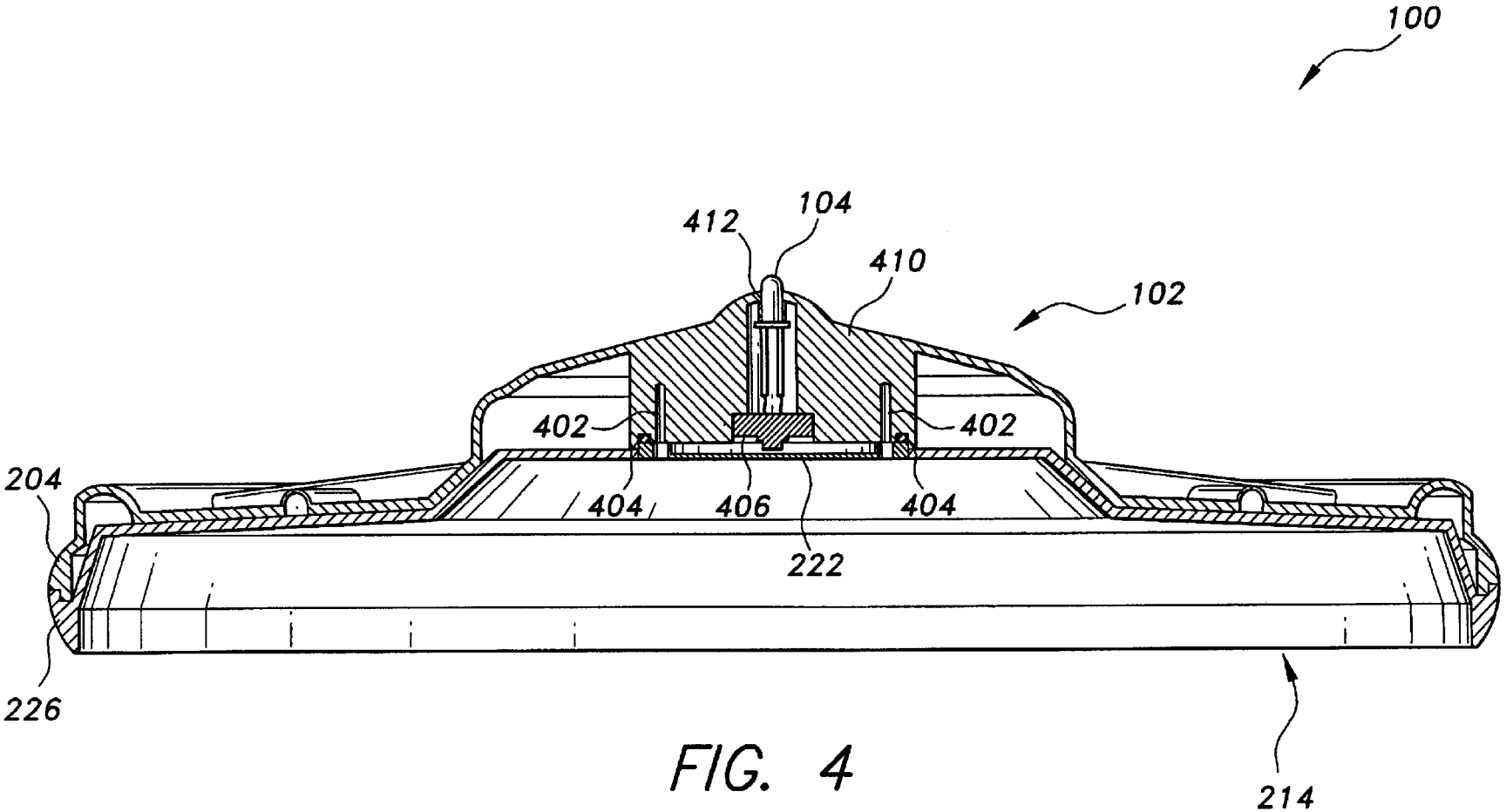
FIG. 4 is a section view drawn along lines 4—4 of FIG. 3.

A circular battery compartment cover 218, adapted to provide a snug fit within the opening in the lower disc member 214, has an upper and lower surface formed of molded plastic. The cover 218 has a narrow ledge 230 on the periphery of its upper surface, which cooperatively engages a recess molded within the underside of the dome 102. The ledge 230, thicker than the central portion 222 of the cover 218, has apertures to receive mounting screws 220. The screws 220 are received by blind threaded recesses 402 in the underside of the dome 102 as shown in FIG. 4 and best shown in FIG. 7B. A rubber or other waterproofing gasket 216 placed within a recess 404 surrounding the underside perimeter of the dome 102 provides a waterproof seal between the battery cover 218 and the underside of the dome 102.

Figure 3:
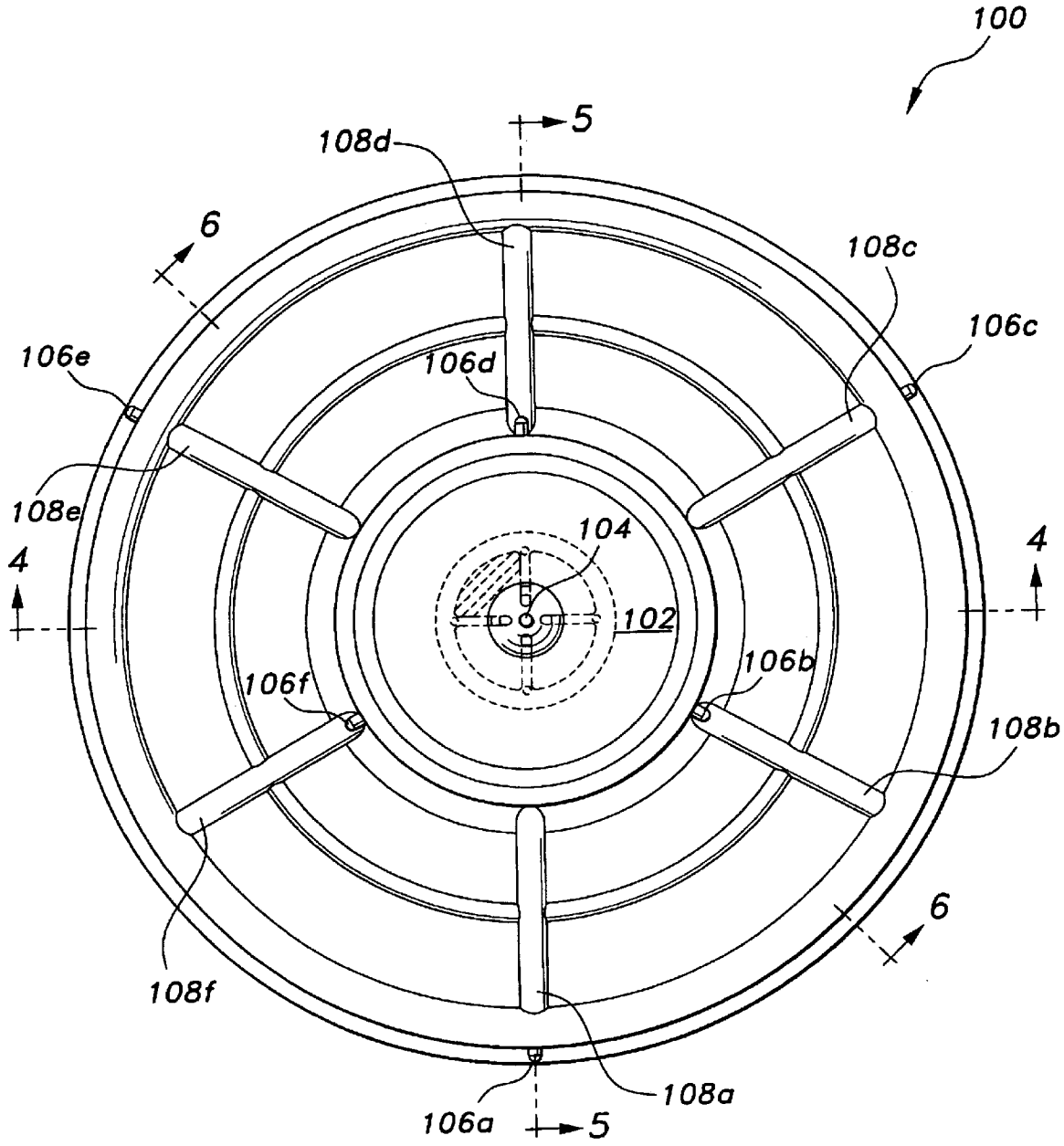
FIG. 3 is a top view of the waterproof illuminated disc flyer of FIG. 1.
Figure 5:
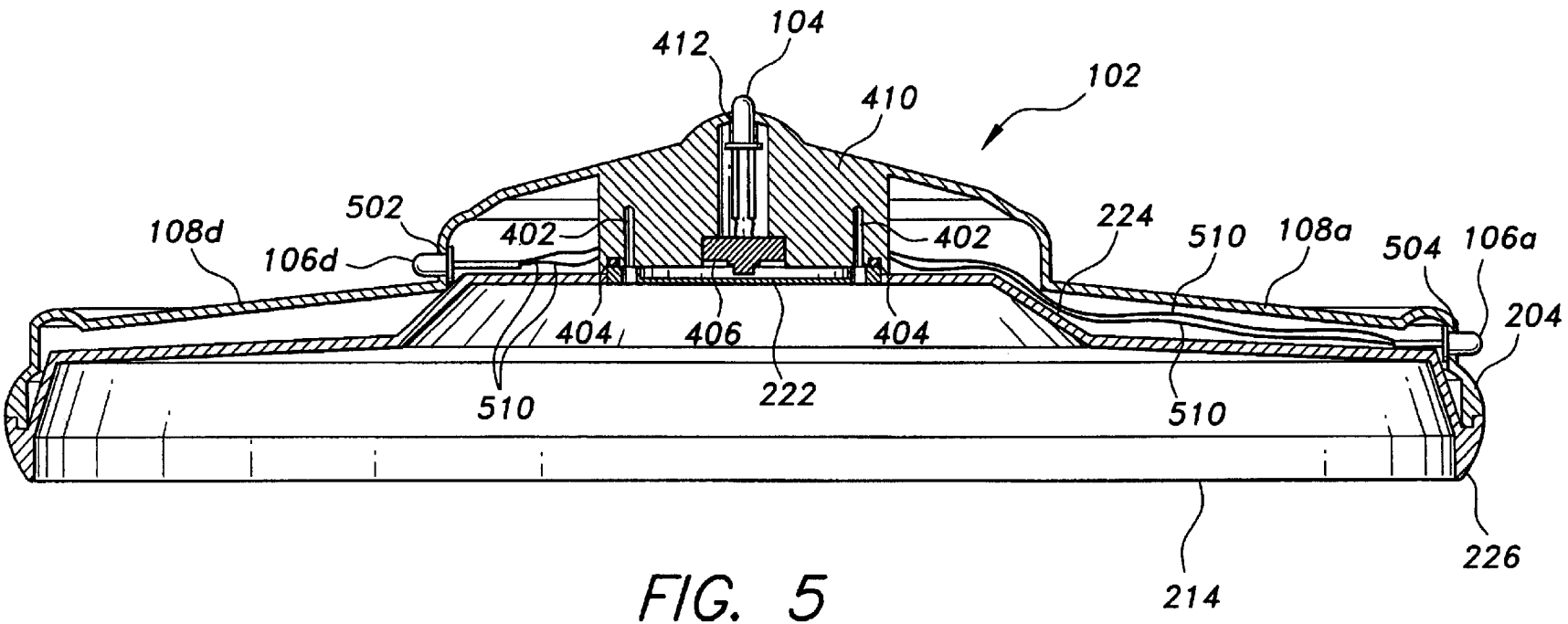
FIG. 5 is a section view drawn along lines 5—5 of FIG. 3.
Figure 6:
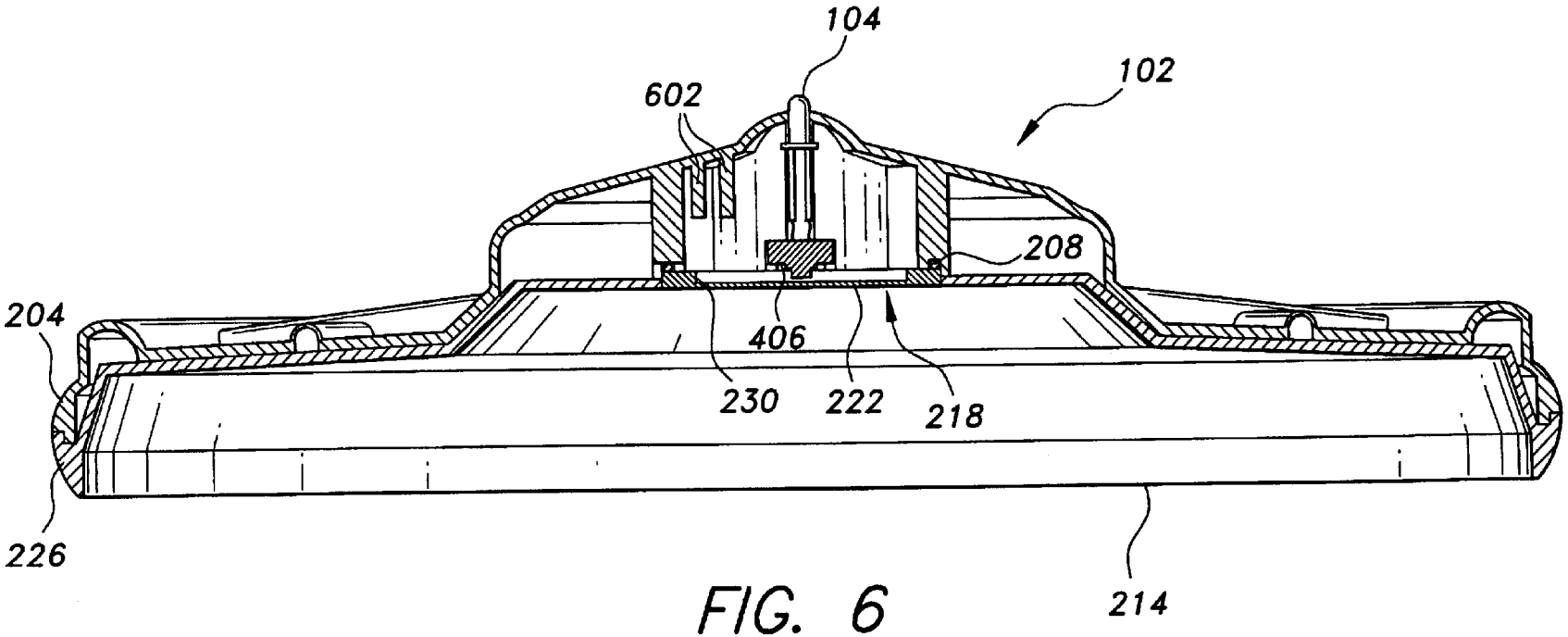
FIG. 6 is a section view drawn along lines 6—6 of FIG. 3.

FIG. 3 illustrates the top view of the illuminated flying disc. FIGS. 4–6 illustrate different section views of the flying disc 100. The outer rim of the flying disc 100 is formed by interlocking peripheries 204, 226 of the upper and lower discs 202, 214, and may be sonic welded or fastened by any other means known in the art for providing a waterproof seal between plastic components. A miniature push button switch 406, supported by a seat molded in supporting walls 410 operates to supply an effective voltage to the LEDs. The pushbutton portion of switch 406 substantially abuts the interior surface of the thin center portion 222 of the battery cover 218, whereby depressing the exterior portion of the battery cover 218 operates to toggle the pushbutton 406 from an operative to an inoperative state.

As best shown in FIG. 5, LED 104 protrudes through an aperture 412 molded or cut through the top of dome 102. LEDs 106*a–f* mounted at the alternating ends of spokes 108*a–f* protrude from apertures cut or molded in the upper disc member 202, and are held in place by the sloping surface of the lower disc member 214 once the two disc members 202, 214 are joined together. FIG. 5 further highlights the wire access channel 224 molded into the lower disc member 214 which provides access for electrical wire 510, which carries an operative voltage to the terminals of LEDs 106*a*, 106*c*, and 106*e* located on the periphery of the upper disc member 202. The lower disc member is concave with a stepped configuration, sloping from the center to the outer rim. The outer rim of the flying disc 100 projects slightly outward beyond LEDs 106*a*, 106*c*, and 106*e* in order to protect them from damage. The electrical connection of the LEDs and other electrical components will be described in the discussion of FIGS. 7A–9.

Figure 7A:
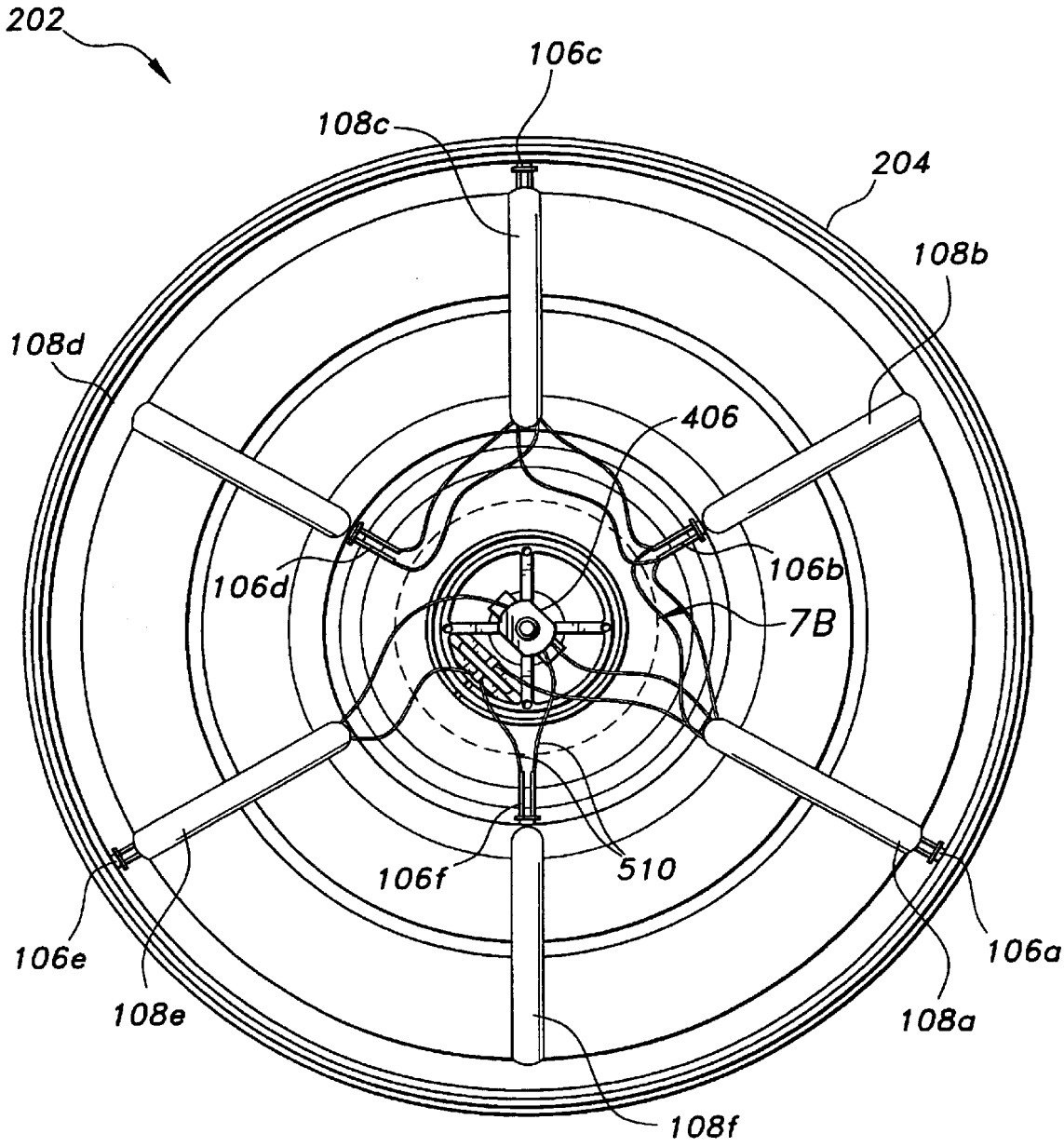
FIG. 7A is a bottom view of a first embodiment of the present invention.
Figure 7B:
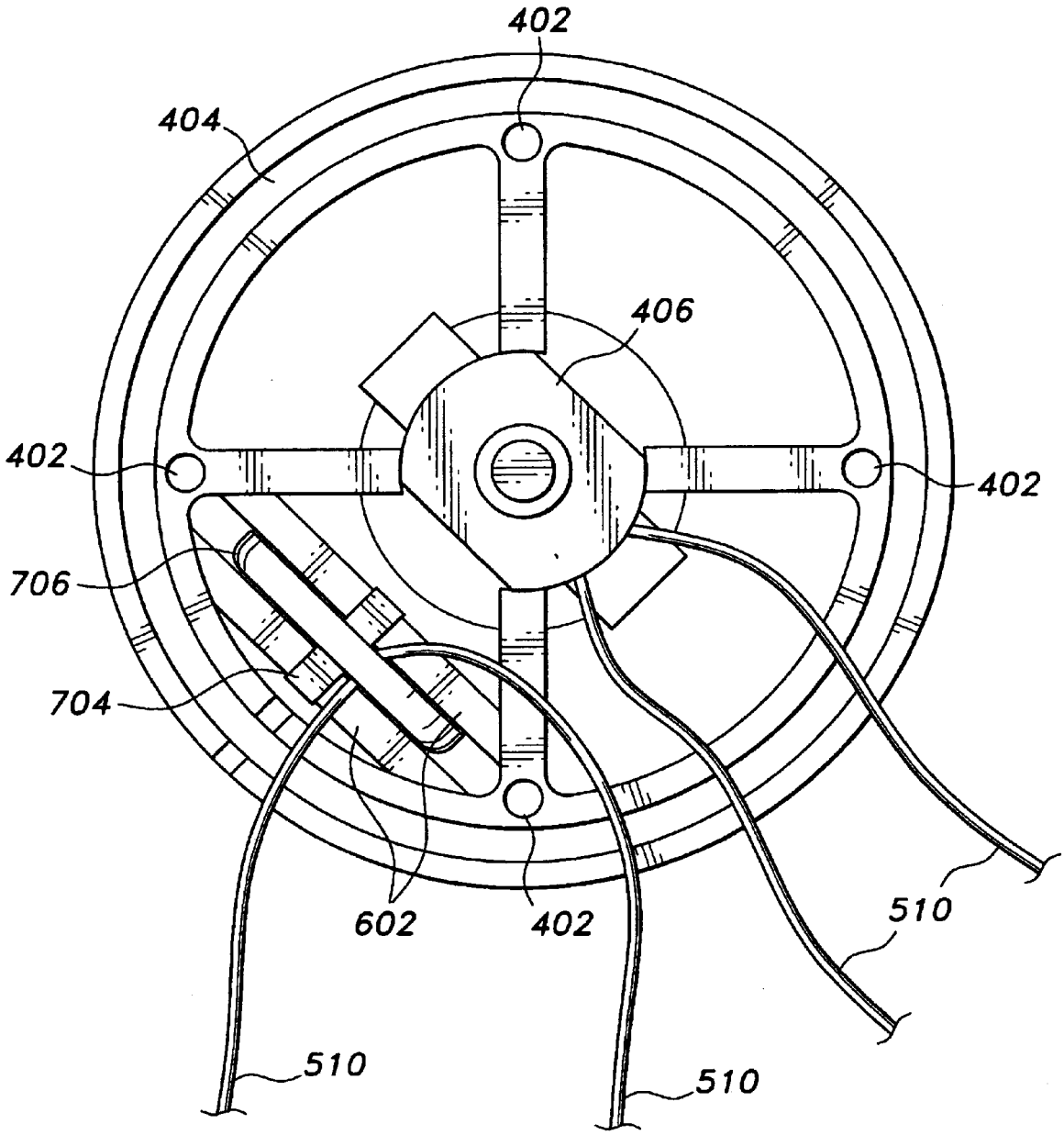
FIG. 7B is an enlarged view of detail 7B of FIG. 7A.

FIGS. 6 and 7B illustrates the battery supports 602 molded in the upper disc member for stabilizing a battery 706, the battery accessed by removing battery cover 222. FIG. 7B shows battery 706 and battery clip 704. The battery clip 704 fits over battery supports 602 and is designed to provide a biasing surface abutting the battery 706. The battery 706 is of the small, lithium variety commonly used in similar low power applications.

As shown in FIG. 7A, electrically conducting wire 510 interconnects LEDs 104, 106*a–f*, battery 706, and pushbutton 406. Spokes 108*a*, 108*c*, and 108*e* form a channel between the upper and lower disk members, providing access for wire 510 electrically connecting the terminals of LEDs 106*a*, 106*c*, and 106*e* disposed the outer periphery of the flying disc 100.

As previously disclosed, FIG. 7B illustrates the battery compartment underneath dome 102, the compartment containing a battery 706 and pushbutton switch 406.

Figure 8:
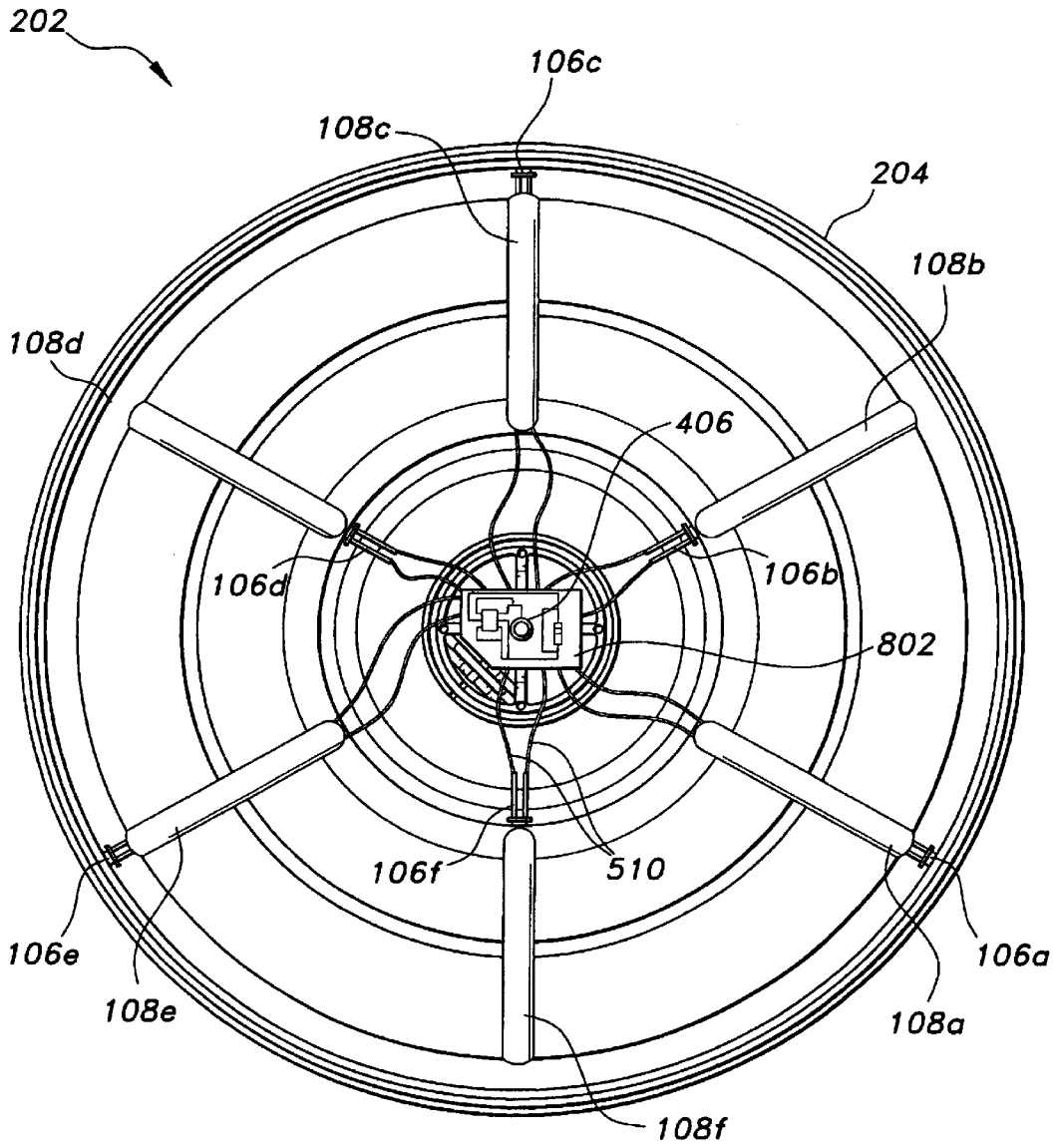
FIG. 8 is a bottom view of a second embodiment of the present invention having an integrated printed circuit board.
Figure 9:
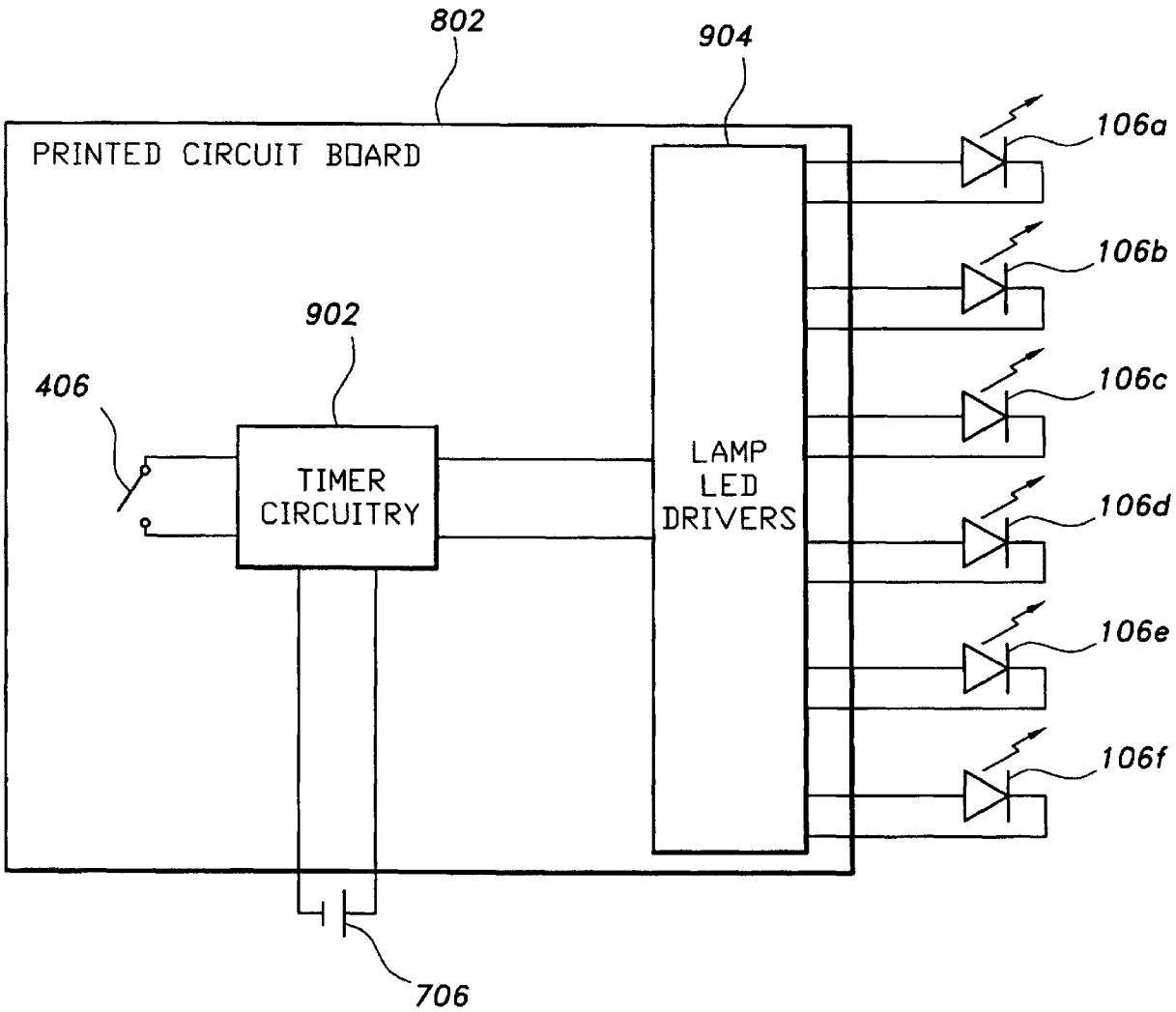
FIG. 9 is a representative schematic of the lighting circuit of the waterproof illuminated disc flyer of FIG. 8.

One embodiment of the present invention 100 comprises a relatively simple electric circuit whereby the pushbutton switch 406 provides an operative voltage to the LEDs disposed on the flying disc 100. The LEDs may be standard LEDs available in a variety of colors, high-intensity LEDs, flashing LEDs, or any combination of LEDs, incandescent lamps or other lighting devices known to those in the art for providing an esthetically pleasing visual effect. As shown in FIG. 8 and in greater detail in FIG. 9, a timing circuit 902 and lamp driver circuit 904 mounted on a printed circuit board 802 may be incorporated to achieve a more elaborate visual effect, e.g., flashing lights. Timer and lamp driver circuits have been well known in the art for years, and commonly include one-chip timers and lamp drivers.

Thus, the waterproof illuminated disc flyer 100, in its most basic form, has a battery, pushbutton switch, and a plurality of LEDs mounted in a waterproof plastic enclosure, enabling the flying disc to be used after dark and in or near the water. It is to be understood that the present invention is not limited to the embodiments described above, but encompasses any and all embodiments within the scope of the following claims.

I claim:

1. A waterproof, illuminated disc flyer, comprising:

an upper disc member having an upper surface, a lower surface, a circular periphery, a centrally disposed dome and a plurality of molded spokes uniformly spaced and extending radially outward from the dome to the periphery;

a concave lower disc member having an outer periphery sealed to the periphery of the upper disc member, the lower disc member having an opening defined therein defining an inner periphery and forming an entrance to a chamber defined under the dome;

a plurality of lights, the lights protruding outwards at alternating opposite ends of the plurality of molded spokes and at least one of the lights extending upward from the centrally disposed dome;

a cover removably mounted over the opening in said lower disc member;

waterproofing means for providing a waterproof seal between said cover and said lower disc member; and electric circuit means for supplying power to the lights.

2. The waterproof illuminated disc flyer according to claim 1, further comprising a battery clip disposed in the chamber under said dome.

3. The waterproof illuminated disc flyer according to claim 1, further comprising a switch disposed in the chamber under said dome.

4. The waterproof illuminated disc flyer according to claim 1, further comprising a plurality of support walls disposed under said dome, each of said walls having a threaded blind bore defined therein.

5. The waterproof illuminated disc flyer according to claim 1, wherein said cover is a molded plastic disc, the cover having an outer flange, a flexible membrane central to said cover, and a plurality of apertures uniformly distributed along the outer flange.

6. The waterproof illuminated disc flyer according to claim 5, further comprising a pushbutton switch having a depressible button generally in contact with the membrane portion of said cover, whereby depressing the outer surface of said membrane operates said switch.

7. The waterproof illuminated disc flyer according to claim 1, further comprising a waterproof gasket disposed between the lower surface of said upper disc member and said cover.

8. The waterproof illuminated disc flyer according to claim 1, wherein the upper surface of said upper body slopes from the center to the outer periphery with the lowermost outer edge projecting outward, slightly beyond the end of said lighting means, thereby protecting said lights.

9. The waterproof illuminated disc flyer according to claim 1, further comprising a printed circuit board disposed in the chamber under said dome, the printed circuit board electrically connected to said electric circuit means.

10. The waterproof illuminated disc flyer according to claim 9, wherein said circuit board further comprises electronic circuitry means for controlling said lights.

11. The waterproof illuminated disc flyer according to claim 1, wherein said upper disc, said lower disc, and said cover are comprised of molded plastic.

12. The waterproof illuminated disc flyer according to claim 1, wherein said lights comprise light emitting diodes.

13. The waterproof illuminated disc flyer according to claim 1, wherein said upper disc is sonic welded to said lower disc, whereby said disc flyer has positive buoyancy when placed in fresh water.

* * * * *